United States Patent [19]

Collombin et al.

[11] 4,083,129

[45] Apr. 11, 1978

[54] ARTICULATED CASING FOR SKI BOOTS

[76] Inventors: Andre' Marcel Collombin, Avully, Geneva, Switzerland; Georges Pierre Joseph Salomon, Bordet a Quintal 74, Haute-Savoie, France

[21] Appl. No.: 635,593

[22] Filed: Nov. 28, 1975

[30] Foreign Application Priority Data

| | | |
|---|---|---|
| Nov. 28, 1974 | Switzerland | 15790/74 |
| Nov. 5, 1975 | Switzerland | 14248/75 |

[51] Int. Cl.[2] ..... A43B 5/04

[52] U.S. Cl. ..... 36/117

[58] Field of Search ..... 36/83, 117, 118, 120, 36/121, 85

[56] References Cited

U.S. PATENT DOCUMENTS

| | | | |
|---|---|---|---|
| 3,313,046 | 4/1967 | Werner et al. | 36/121 |
| 3,645,017 | 2/1972 | Hickmann | 36/120 |
| 3,844,055 | 10/1974 | Koyama et al. | 36/120 |

FOREIGN PATENT DOCUMENTS

| | | | |
|---|---|---|---|
| 2,031,751 | 1/1972 | Germany | 36/120 |

*Primary Examiner*—Patrick D. Lawson

*Attorney, Agent, or Firm*—Young & Thompson

[57] ABSTRACT

An articulated casing for ski boots comprises a plurality of rigid sections articulatedly interconnected for vertical swinging movement relative to each other about horizontal axes. In a preferred form, four such elements are provided, one comprising a sole or base, another comprising an upper which is pivotally mounted to the front of the base, and which may be in two parts that swing about axes parallel to the length of the base, and a third and fourth forming the front and rear of a boot top, at least one of which is pivoted to the rear of the base, the other being pivoted also to the rear of the base or to the rear of the upper. The various elements can be latched together in closed relationship, in which case they fold down upon each other to internest. Means are provided for securing the articulated parts in extended or use position; and the same means may hold the parts in the folded nested position. A waterproof sock can be provided within the casing.

19 Claims, 25 Drawing Figures

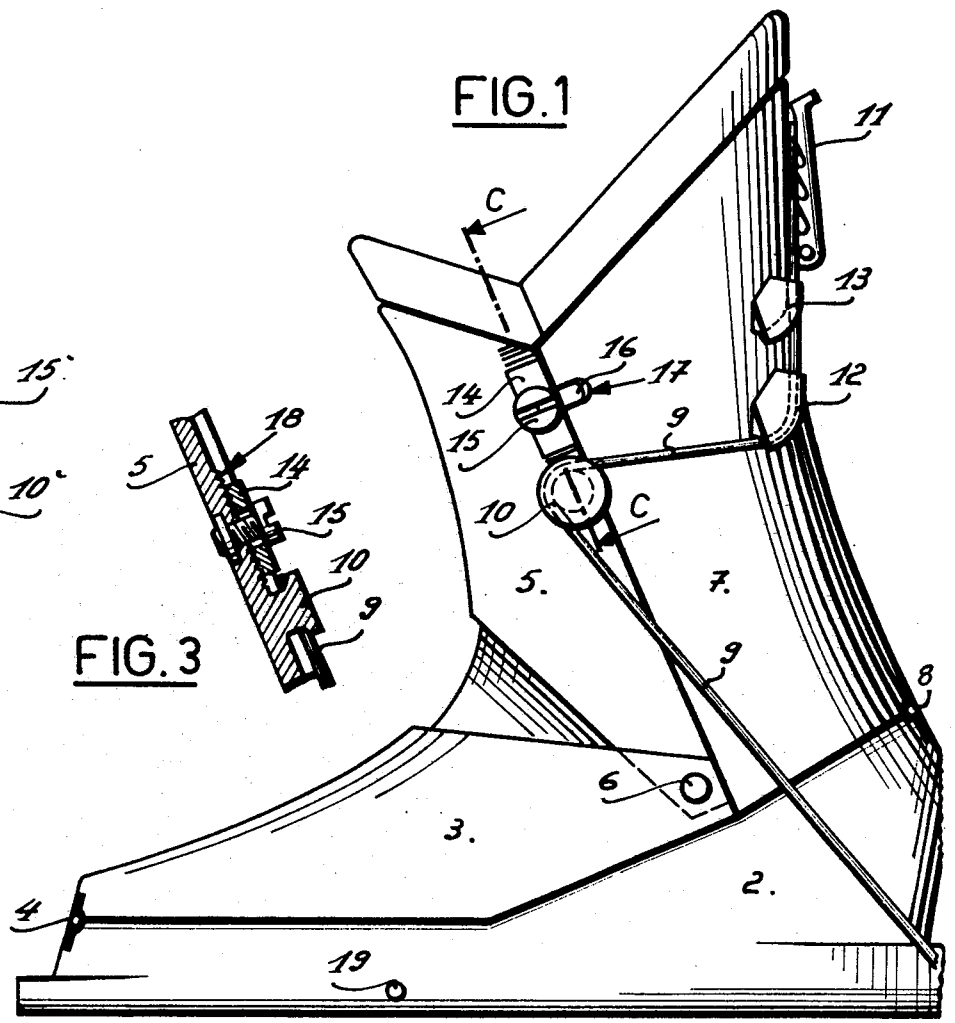
FIG.1
FIG.3
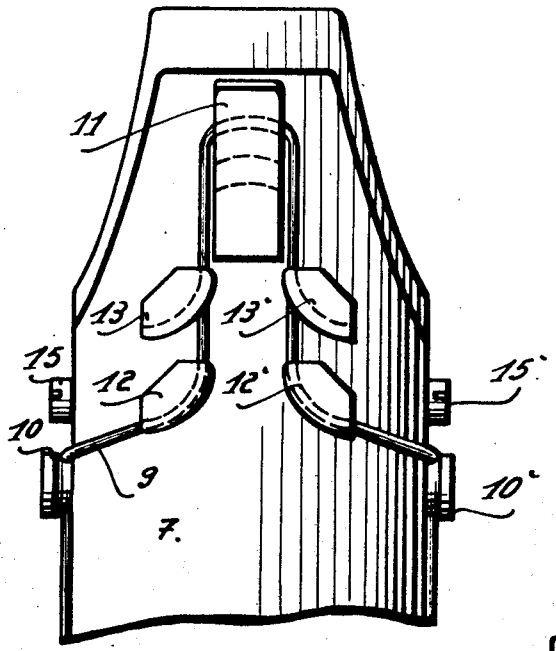
FIG.2

ARTICULATED CASING FOR SKI BOOTS

The present invention relates to an articulated casing for ski boots.

Ski boots should have a number of characteristics that often seem to be mutually exclusive, for example rigidity and comfort, strength and lightness, etc. It is difficult to satisfy these requirements by a boot comprising a single member. A number of efforts have been made to devise ski boots comprised by several members each performing its now function; however, the constructions that have been thus far provided, such as the clam-shell construction in which two parts of the boot are articulated at the level of the sole along an axis extending lengthwise of the sole, have not been entirely satisfactory. For example, with such boots, it is necessary to secure them to the feet before attaching them to the skis.

It is already known to provide ski boots constituted by a plastic shell which imparts rigidity to the boot and a sock of a flexible material which provides comfort. In recent years, the height of ski boots has increased, until it is now at mid-calf. This kind of ski boot is hard to put on because the top does not open wide and is very rigid. Also, they are heavy. Thus the present invention aims to provide a ski boot which can open wide to receive the foot and which may be folded so as to occupy a small volume when it is not in use, at which time it may be either secured to the ski or removed.

In what follows, the ski boots referred to should be understood to include the following:

- conventional ski boots provided with bindings of the universal type;
- ski boots having unlatching elements for a selected mode of securement;
- unlatching plate provided with a casing surrounding the foot of the skier adapted for appropriate securement to the ski.

The present invention has as its object the provision of a casing for a ski boot comprising a flexible sock, boot or the like secured or not within a rigid casing comprising at least two parts that are articulated to each other, characterized in that the parts cooperate in the position of use and encase each other in the position of non-use, and in that the articulations permit a folding and unfolding such that the casing may be folded on itself to occupy a smaller volume out of use than in use, and in that locking means are provided for maintaining the casing in these positions of use and non-use.

The accompanying drawings show schematically by way of example three embodiments of casings for ski boots according to the present invention.

FIG. 1 is an elevational view of a first embodiment of the invention in extended or operative position;

FIG. 2 is a fragmentary rear elevational view of the embodiment of FIG. 1;

FIG. 3 is a fragmentary cross-sectional view on the line C—C of FIG. 1;

FIG. 14 is a view similar to FIGS. 4 and 8, but

Figure 4:
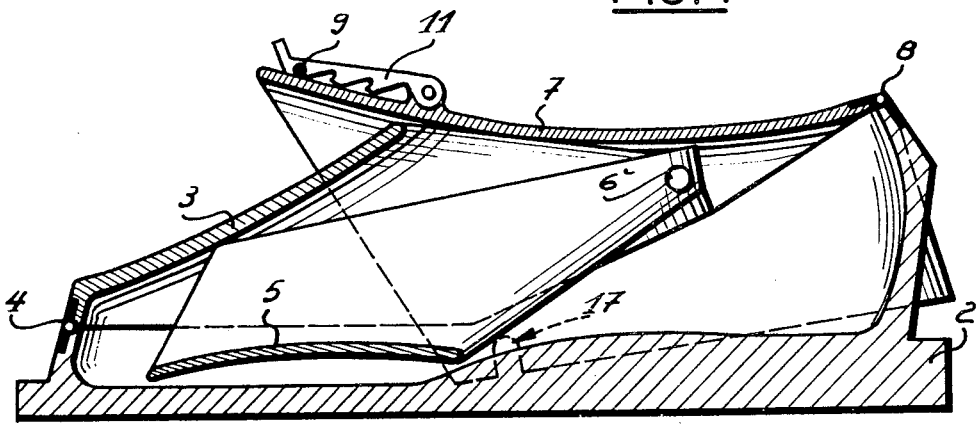
FIG. 4 is a side cross-sectional view of the embodiment of FIG. 1, but in folded position.
Figure 5:
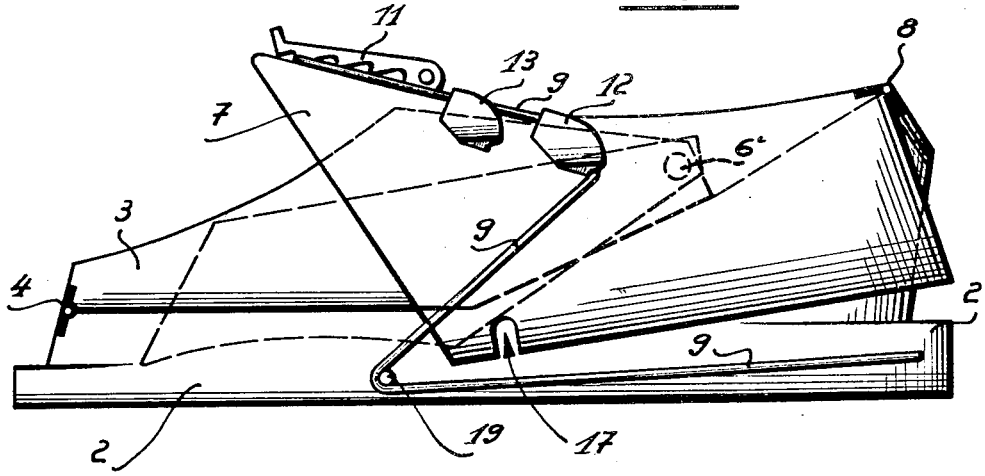
FIG. 5 is a side elevational view of the structure of FIG. 4.
Figure 7:
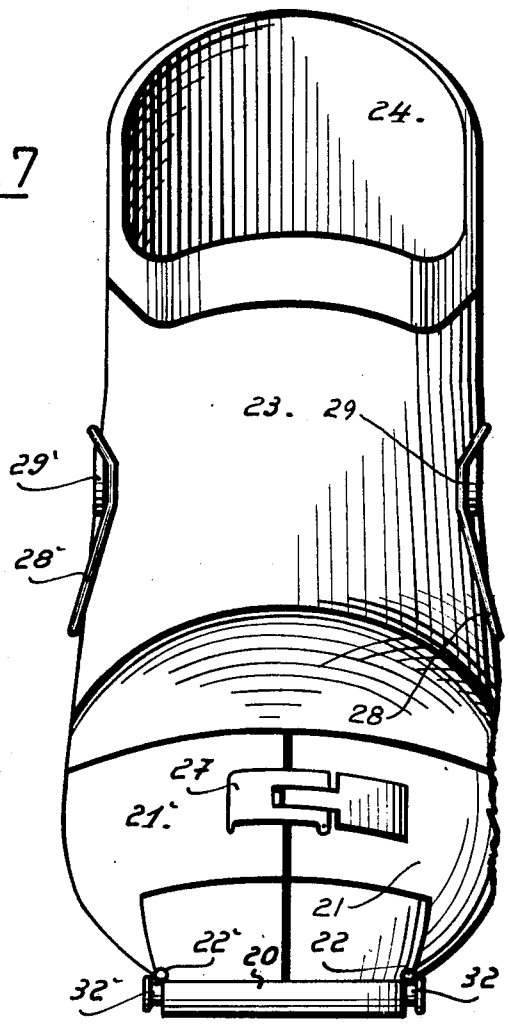
FIG. 7 is a front elevational view of the embodiment of FIG. 6.
Figure 6:
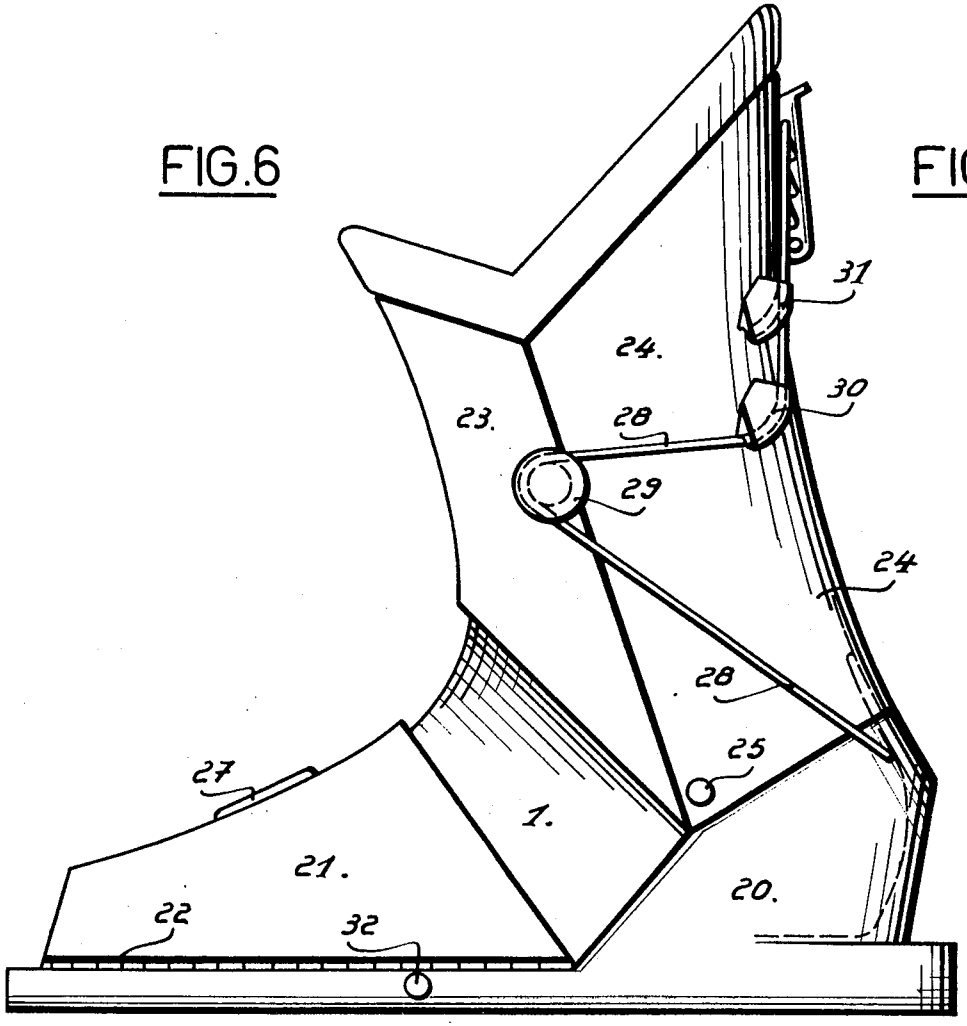
FIG. 6 is a view similar to FIG. 1, but showing the second embodiment of the invention.
Figure 8:
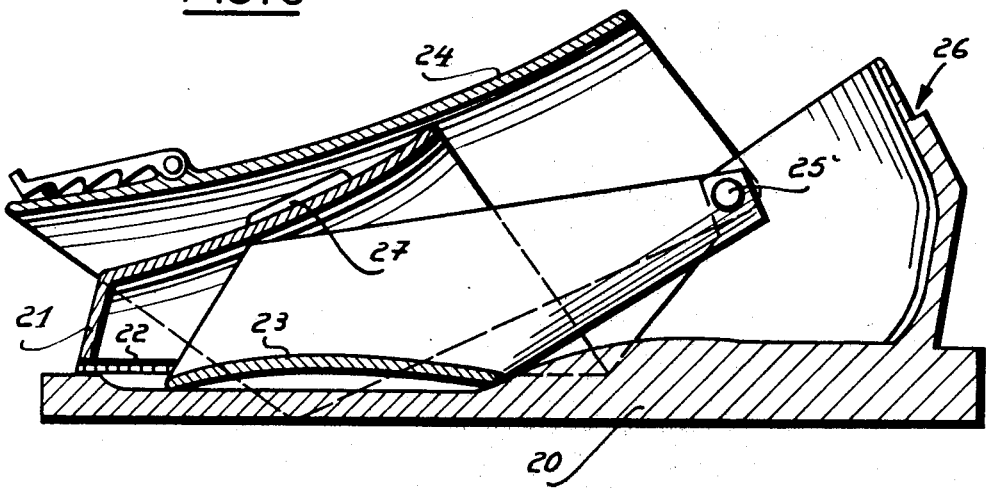
FIG. 8 is a view similar to FIG. 4 but showing the embodiment of FIG. 6.
Figure 9:
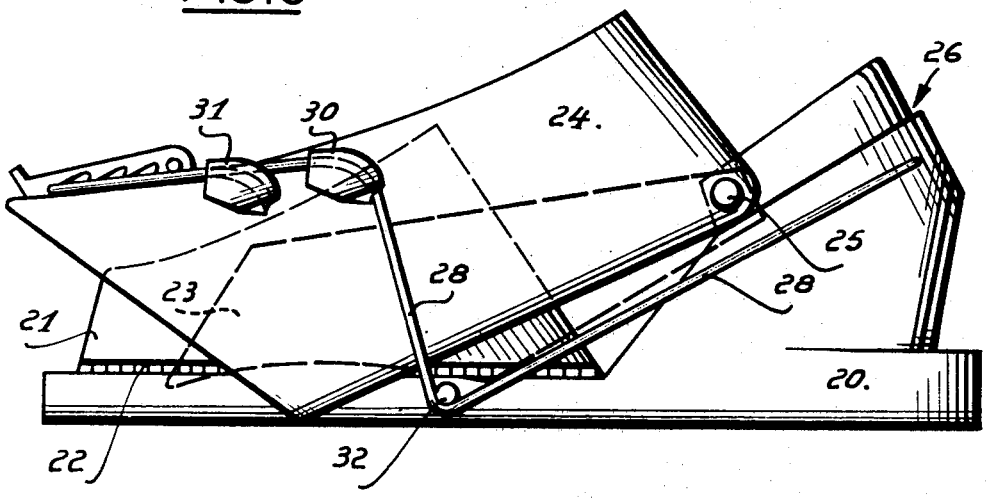
FIG. 9 is a view similar to FIG. 5 but showing the embodiment of FIG. 6.
Figure 10:
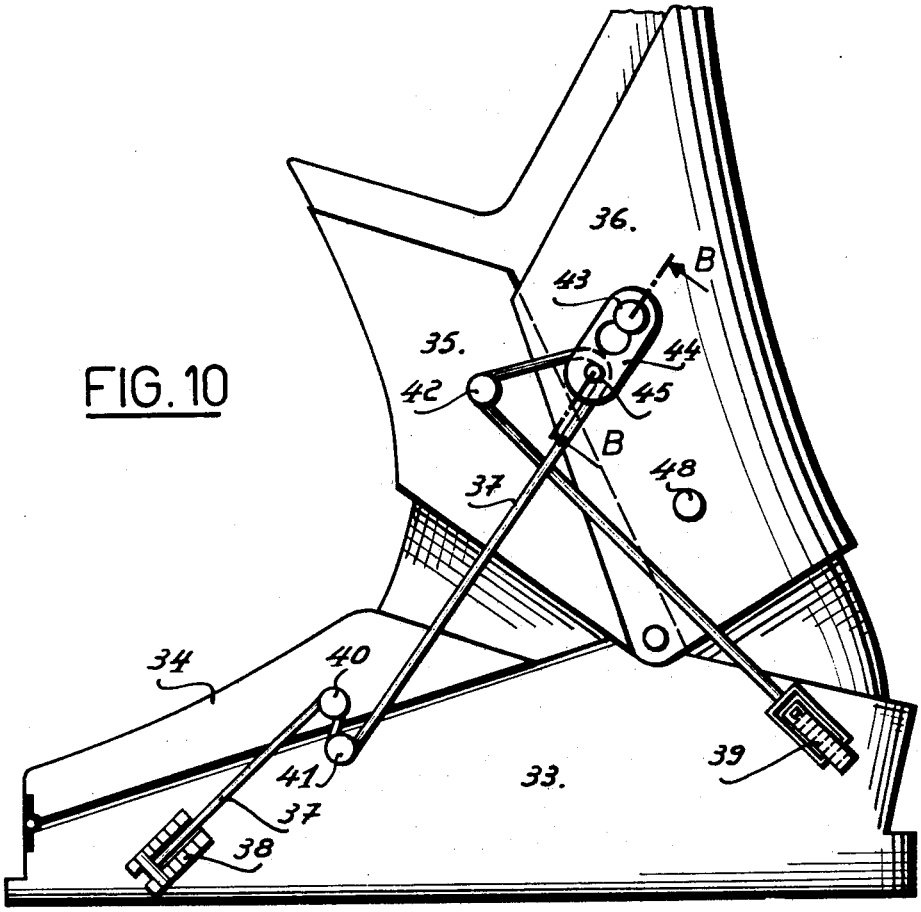
FIG. 10 is a view similar to FIGS. 1 and 6, but showing a third embodiment of the invention.

In general, the present invention is constituted by

- a casing of rigid material (synthetic resin which may be reinforced or not, sheet metal, etc.) provided with articulations of a sufficient number and/or so disposed as to permit relative swinging movement of the articulated parts such that the parts will encase each other, so as to permit wide opening of the parts to insert the foot and also to permit folding of the parts when the device is not in use; and
- a sock 1 within the casing, of a flexible material (leather, polyurethane foam, rubber, etc.).

The sock is

- either fixed to the casing, in which case it folds with the casing; it can advantageously be provided in several separate portions and the casing itself be water-tight;
- or removable, in which case it may be withdrawn from the casing before folding the casing; it will thus be advantageously constructed in a single piece.

The sock should be comfortable, waterproof and resistant to wear. Moreover, in the case in which the sock is designed for wearing after skiing, it should have a sole resistant to abrasion and wear.

FIGS. 1–5 illustrate a first embodiment of the invention. The casing is constituted by

- a base 2 comprising a sole which rises to medium height about the forward portion of the foot and surrounds the heel of the skier;
- an upper 3 articulated relative to base 2 at the forward part of the casing, by articulation 4;
- a forward part 5 of a boot top, articulated on upper 3 by articulations 6 and 6′ on opposite sides of the casing; and
- a rear part 7 of the boot top articulated on and relative to the base 2 by articulation 8 in the region of the heel.

All of these articulations of the casing are horizontal and disposed perpendicular to the lengthwise axis of the ski.

The different portions of the casing that contact each other (3 in contact with 2 and 5 in contact with 7) are so shaped as to form enclosures with each other and overall a continuous enclosure for the lower extremity of the skier.

The different portions of the casing are maintained in an extended position relative to each other by cable 9 fixed to the base 2 in the region of the heel. This cable passes about pins 10 and 10' secured on opposite sides of forward part 5 of the boot top, then about guides 12, 12' or 13, 13'. The tension in cable 9 is applied by a clasp 11 on the rear of the boot top. Regulation of the tension of the cable is effected on the one hand by the different slots in the clasp 11 and on the other hand by the utilization of one or both of the guide systems 12, 12' and/or 13, 13', which of course will also regulate to some extent the position relative to each other of the parts 5 and 7.

Regulation of the inclination of the boot top can be effected by the structure shown in FIG. 3. Piece 14 secured to the forward part 5 of the boot top by screw 15 is provided with a lug 16 that extends into a corresponding slot 17 in rear part 7 of the boot top. Piece 14, as well as the forward part 5 of the boot top, are provided with mating grooves 18 which thus permit regulation of the relative positions of the parts 5 and 14, and hence the relative positions of the parts 5 and 7 of the boot top and thus the angle of inclination of he boot top to the rest of the casing.

To bend the casing, the clasp 11 is opened, the cable 9 is removed from the pins 10 and 10' as well as the guides 12, 12' and/or 13, 13'. The casing is then opened so as to free the skier's foot by unthreading the cable 9 and pivoting the different parts of the casing relative to each other to open position. The sock 1 is removed from the casing when necessary. The forward part 5 of the boot top swings about its axis 6 so as to be entirely disposed within the space comprised between the base 2 and the upper 3. Then the forward portion 7 of the boot top is swung down so as to cover the base 2 and the upper 3. The different portions of the casing are so sized and shaped as to permit this compact folding.

Cable 9 passing behind pins 19 and 19' on opposite sides of the casing, permits holding the various parts in their folded positions, the cable being again held tight by the closing of the clasp 11.

The second embodiment is shown in FIGS. 6–9. In this embodiment, the casing is constituted by

- a base 20 constituted by a sole and a part surrounding the skier's heel;
- an upper in two parts 21 and 21' articulated lengthwise of the sole by hinges 22 and 22' parallel to the length of the casing. The two parts 21 and 21' of the upper meet in the medial plane of the casing;
- a boot top comprised by a front part 23 and a rear part 24. The parts 23 and 24 are articulated on the same axis 25, 25' near the tibio-tarsal joint of the wearer. The rear part 24 abuts rearwardly on the base 20 at support 26. The two parts 23 and 24 are free to swing forwardly.

As in the preceding embodiment, the parts 21 and 21' on the one hand and the parts 23 and 24 on the other hand may abut or interfit.

In this embodiment, the two parts 21 and 21' of the upper are locked together by the latch 27. The parts 23 and 24 of the boot upper are fixed about the leg of the skier against the support 26 of the base 20 by tension of the cable 28 passing about pins 28 and 29 and guides 30, 30' and/or 31, 31'.

Regulation of the tension of the cable 28 is effected as in the first embodiment.

Bending of the casing takes place with spreading apart of the portions 21, 21' of the upper, the latter pivoting about their hinges 22, 22', while swinging upper part 23 of the boot top about its axis in a manner such that it enters between the upper parts 21 and 21', then by closing the parts 21, 21' and swinging down the rear part 24 of the boot top about its axis so that it covers the forward part of the foot. The securement of the different parts in folded position is effected by passing the cable 28 about pins 32, 32' on opposite sides of the sole of the casing.

FIGS. 10 to 14 show a third embodiment of the invention. In this embodiment, the casing comprises

- a base 33 which rises on each side of the sole to a low height and surrounds the heel;
- an upper 34 pivoted on an axis 46 perpendicular to the length of the casing at the forward end of the casing;
- front and rear parts 35 and 36 of the boot top, pivoted on an axis 47, 47' perpendicular to the length of the casing, and at the level of the tibio-tarsal joint of the wearer. These two parts 35 and 36 of the boot top are free to rotate about their axis of articulation both forwardly and rearwardly.

In this latter embodiment, the casing is fixed in its use position by means of two cables 37 and 37' secured to the base 33 by ferrules 38 and 38' and tensioned by means of clasps 39 and 39'. Closing of the casing is effected by the tension in cables 37 and 37' about the pins 40, 40', 41, 41' and 42, 42'. The parts 35, 36 are prevented from rotation by grasping of the cable 27 in the recessed clamp 44, this clamp being on the pin 43 in an appropriate opening.

Cable 37 is trained in such a manner that when the skier leans back, the portion of the cable which connects the pin 41 to the clamp 44 is tensioned. The line of action of this portion of the cable is relatively far from the swinging axis of parts 35, 36. As a result, the elasticity of the cable permits only a limited rearward bending of the casing and the skier has firm rearward support. On the other hand, when bending forward, it is the portion of the cable between the pin 42 and the clasp 39 which is tensioned. The line of action of this portion of the cable being close to the axis of rotation of the boot top, the elasticity of the cable permits greater rotation forwardly than was the case to the rear. The skier thus has a boot top with greater flexibility forwardly than rearwardly.

Figure 11:
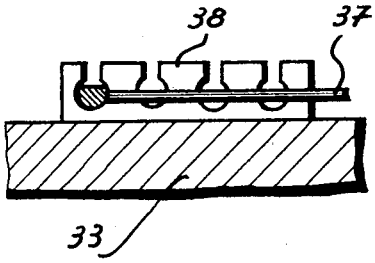
FIG. 11 is a fragmentary cross-sectional view of a portion of FIG. 10.
Figure 12:
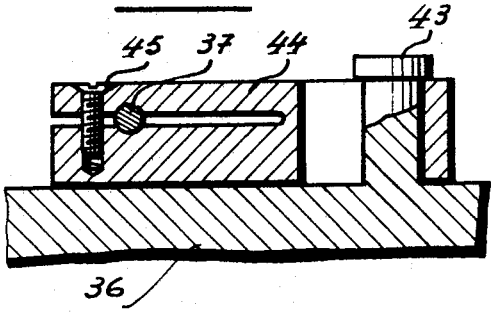
FIG. 12 is a fragmentary cross-sectional view on the line B—B of FIG. 10.
Figure 13:
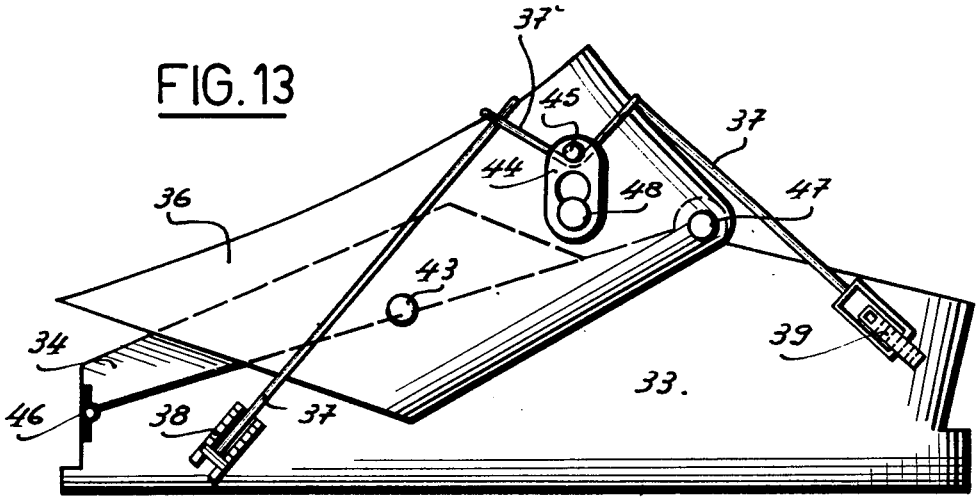
FIG. 13 is a view similar to FIGS. 5 and 9, but showing the embodiment of FIG. 10.
Figure 14:
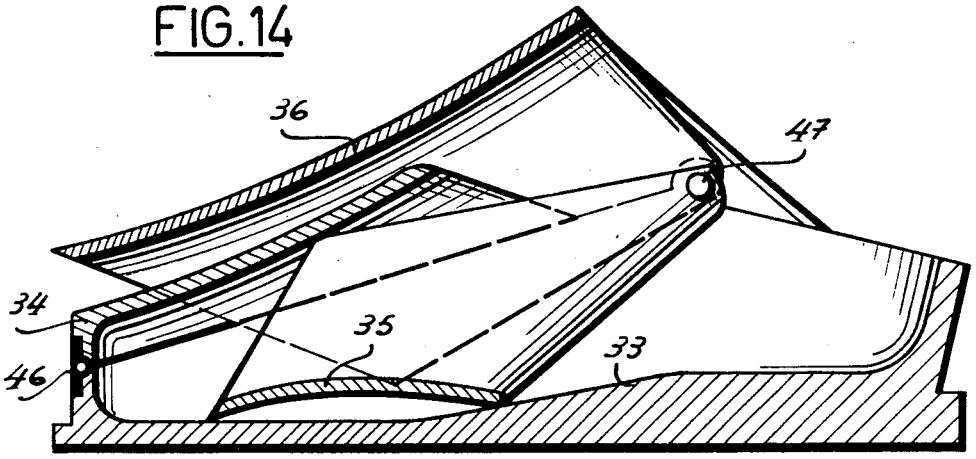

Tension in the cable may be adjusted at one end by manipulation of the ferrules 38 and 38', as shown in FIG. 11, and at the other end by the clasps 39, 39'.

Regulation of the inclination of the boot top is effected by regulation of the position of the clamp 44 on the cable 37 with the aid of setscrew 45. See FIG. 12.

Folding of the casing is effected in a manner analogous to the preceding embodiments. The different portions of the casing are held in folded position by cables 37 and 37' passing over part 36 of the boot top, the clamps 44, 44' being then mounted on the pins 48', 48, respectively, and then the cable tensioned by means of the clasps 39, 39'. As in the preceding embodiments, the contacting portions of the casing may abut or interfit.

In a modification of this latter embodiment, only a single cable need be used.

Referring now to FIGS. 15–19, a device is shown comprising a central sole or rigid shell base 61, in the form of a trough secured to a base plate 62. At its forward end is articulated a rigid member 63 which is also in the form of a trough, pivotally connected thereto at 64, 64'. At the rear end of trough 61 is articulated a rigid element in two parts 65, 65' also in the form of a trough, these latter being articulated to each other at 66, 66' and to central trough 61 at 67, 67'.

The pivotal axes 64, 64' and 67, 67' are horizontal, fixed and perpendicular to the longitudinal axis of trough 61; while the axis 66, 66' is also horizontal and perpendicular to the longitudinal axis of trough 61 but is swingable relative to trough 61 in the arc of a circle about axis 67, 67'.

Figure 15A:
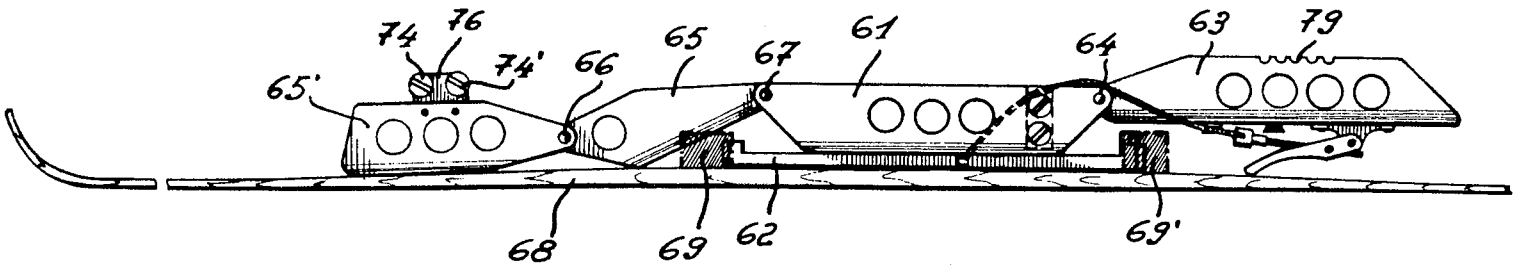
FIGS. 15A and 15B are schematic views, respectively in elevation and top plan, of another embodiment in its position when out of use.
Figure 15B:
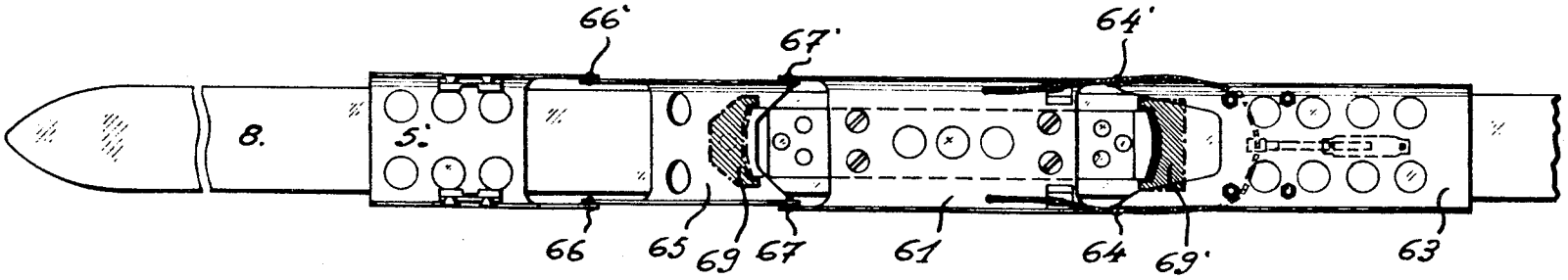
Figure 16A:
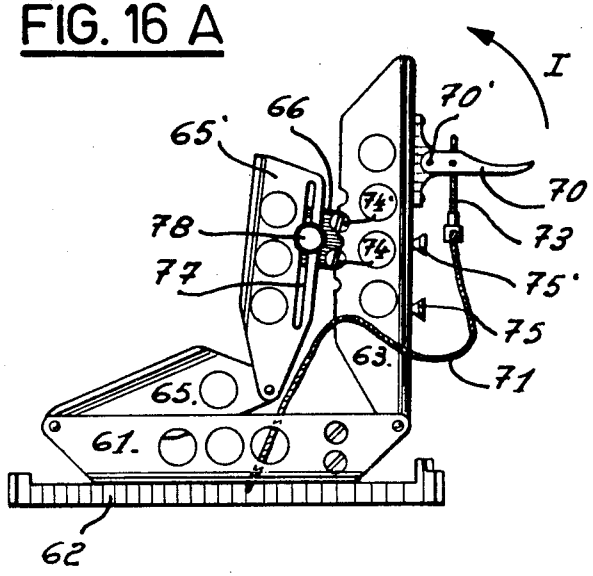
FIGS. 16A and 16B are somewhat schematic side elevational views of the embodiment of FIGS. 15A and 15B in partially out-of-use position and in use position, respectively.
Figure 16B:
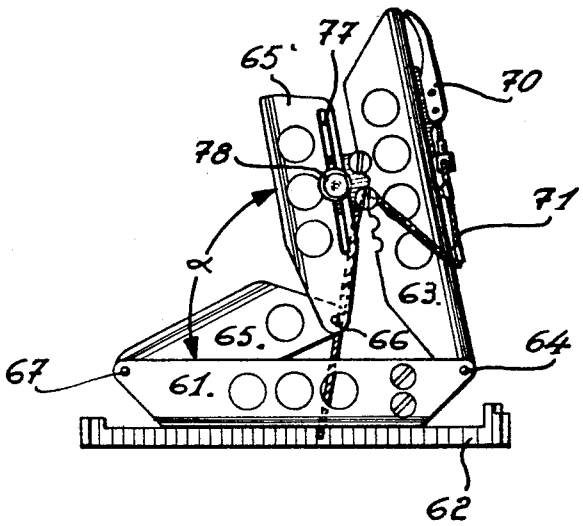

Base plate 62 is adapted to be fixedly secured to ski 68, for example by means of known bindings comprising a rear abutment 69 and a clamp 69'. In the out-of-service position, for example for transportation, the device can be folded down as shown in FIGS. 15A and 15B, the element 63 being completely swung forwardly and the elements 65, 65' being completely swung rearwardly. Four rigid elements 61, 63, 65 and 65' are thus disposed parallel to the ski and in line with each other. The volume occupied is thus reduced to a minimum, particularly as to its height. On the other hand, in the operative position, as shown in FIGS. 16A and 16B, the element 63 is moved rearwardly while the elements 65, 65' are swung forwardly, the pivotal axis 66, 66' describing the arc of a circle having as its center the axis 67, 67', and the element 65' thus becoming about parallel to element 63. In this embodiment, the apparatus according to the invention is provided with means for locking the rigid elements 61, 63, 65 and 65' in operative position, and constituted for example by a pull cable comprising clasp 70 carried by the rear member 63, as shown in FIGS. 16A and 16B, and a cable 71 secured to trough 61 and connected to clasp 70 by means of an adjustment screw 73, permitting one to adjust the length of cable 71. To lock the device, the cable 71 is passed about the pins 74 and 74' and 75 and 75', and then the clasp 70 is swung in the direction of the arrow I in FIG. 16A to the position shown in FIG. 16B, swinging about the pivot 70'. The pins 75 and 75', which are screw heads, are fixed to the rear element 63, while the pins 74 and 74' are fixed to a plate 76 which may be either fixed on the forward element 65' or may slide vertically in an opening 77 provided in element 65, for example by means of a screw-threaded pin fixed to plate 76, a knurled knob 78 permitting the fixing of the plate 76 in a predetermined position relative to the opening 77. The pins 74 and 74', which are screw heads, have also the function of connecting the element 65' with the rear element 63, and cooperate with a series of indentations 79 provided on the forward edge of element 63, so as to fix the relative position of the two rigid elements 63 and 65'.

Figure 17A:
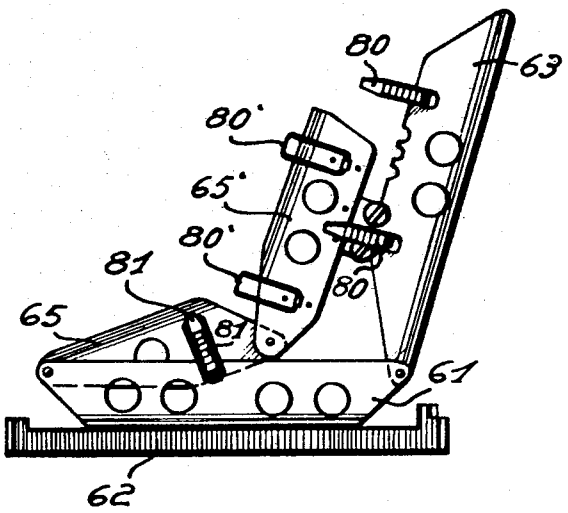
FIGS. 17A and 17B are views similar to FIGS. 16A and 16B, respectively, but of a modified form of the device.
Figure 17B:
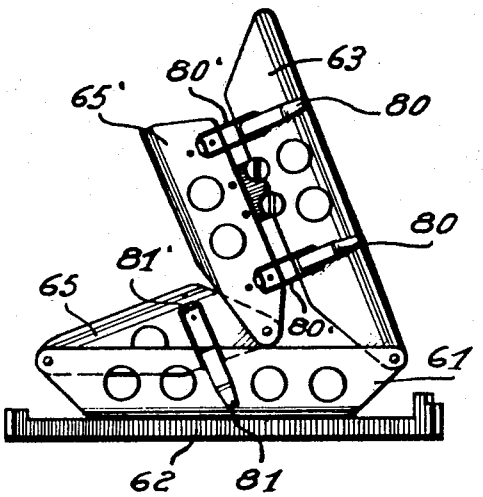

Another embodiment of locking means for the rigid articulated elements is shown in FIGS. 17A and 17B, and is comprised by a system of clasps and buckles. The device of the present invention is thus locked in operative position (FIG. 17B) by clasps 80 and 81 which are secured respectively on the rear element 63 and on the sole 61 and that cooperate with buckles 80' and 81' secured respectively on that part of the forward element 65' which is parallel with element 63 and on the part of forward element 65 which is articulated on the sole 61.

Figure 18:
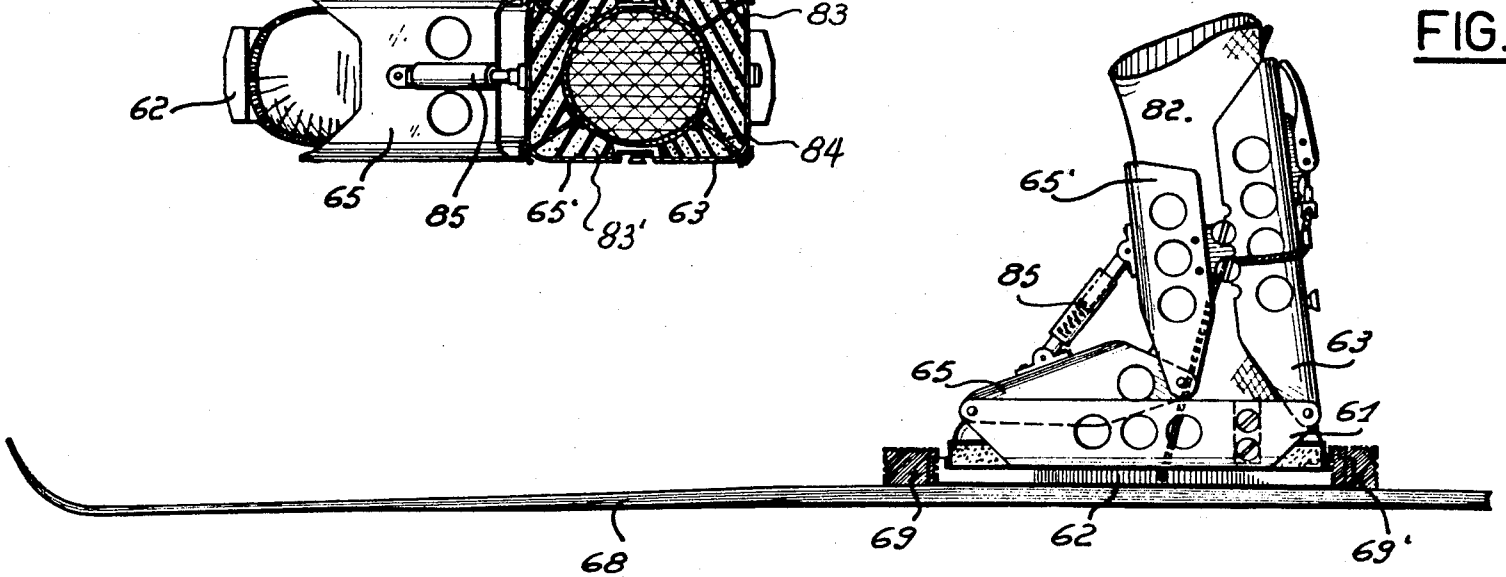
FIG. 18 is a side elevational view of a binding similar to those of FIGS. 16 and 17, in use with a boot and secured to a ski.

FIG. 18 shows an elevational view of apparatus according to the invention in its use position, that is, cooperating with a ski boot 82 so as to maintain the latter on the sole 61. As will be seen from FIG. 18, the element 65 comprises the rigid part retaining the instep, while elements 65' and 63 form a rigid boot top to retain the ankle and the lower part of the leg. As a ski boot utilizable with the device of the invention, a flexible boot, comfortable and watertight may be used, the necessary rigidity being provided by the device itself.

Figure 19:
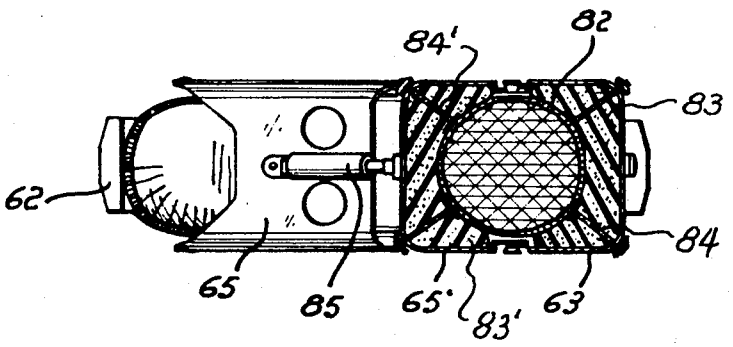
FIG. 19 is a top plan view, partly in section, of the embodiment of FIG. 18.

This boot 82 may comprise an external shape built up by flexible pads to fit the interior of the clamps which are comprised by the rigid elements 63, 65 and 65'. When the boot is plain, the device may be provided with anatomical supports 83, 83' disposed in the anatomical regions subject to the gripping force of the jaws, for example about the ankle and over the instep. These anatomical supports 83 and 83' may be secured for example to the elements 63 and 65', as shown in FIG. 19, by means of screws 84, 84' provided with locking bolts permitting the internal configuration of the supports to be somewhat modified and to secure them more or less strongly against the ski boot. In another embodiment (not shown) the rigid elements 61, 63, 65 and 65' may themselves have a shape complementary to that of the exterior of the boot.

In this embodiment, the locking of the articulated elements 63, 65, 65' may also be effected by means acting on the pivot of each of the articulations. Moreover, shock absorption means may also be provided to absorb bumps transmitted by the ski to the skier, for example by means of a spring-damping piston 85 as shown in FIG. 18, disposed obliquely between the elements 65 and 65' of the device.

Finally, to increase the safety of the skier, the device may comprise security means ensuring the instantaneous unlocking of the locking means of the rigid elements (pull cable, buckles and clasps, etc.) and/or the unlocking of the articulation pivots, when these are subjected to violent shocks or forces that are stronger or more abrupt than a predetermined level, as described in the embodiments first described.

The rigid elements 61, 63, 65 and 65' comprising the apparatus according to the invention should be made of a material which is both light in weight, resistant and rigid, for example aluminum or aluminum alloy, or other light metal alloy, or preferably reinforced plastic, the rigid elements being in the form of open work, as shown in FIGS. 15–19.

This apparatus provides for a rigidification of the boot on the ski, as required for example in competition, by locking all the locking means and blocking means of the rigid elements and/or the articulations. Moreover, the angle $\alpha$ shown in FIG. 16B between the horizontal axis of the sole 61 and the boot top, constituted for example by two rigid elements 65, 65', which is to say between the ski and the leg of the skier, may be selected, before fixing the articulated members in place, by the relative displacement of the two rigid elements 65, 65' parallel to each other and by the predetermined positioning of the pins 74 in the recesses 79, or by securing the plate 76 in the opening 77 or even by setting an analogous slide member (not shown), in a predetermined position. On the other hand, the apparatus according to the invention, as described above, may also be provided for ski tracking; it suffices in that case for example not to lock completely the rigid elements, so that the boot will be retained by the elements 65, 65', but so that the pivotal articulations 64, 64', 66, 66', 67 and 67' will remain free, as well as the structure ensuring the parallel sliding relative to each other of the two rigid elements 65, 65' (see FIGS. 16A and 16B).

Figure 20B:
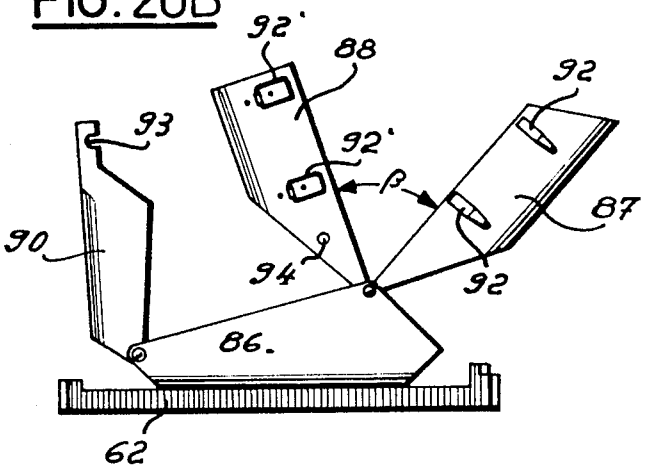
FIGS. 20A, 20B and 20C are somewhat schematic side elevational views of a final embodiment of the invention, respectively in the positions it assumes when out of use, partly in use, and in use.
Figure 20C:
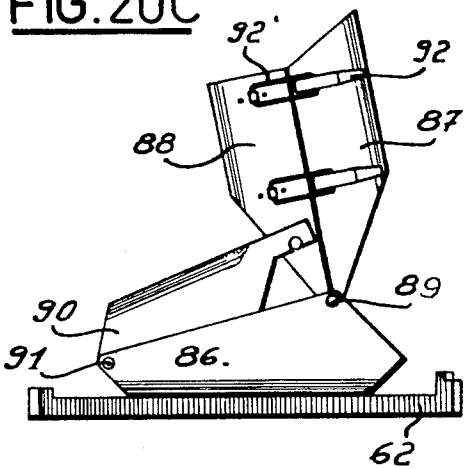
Figure 20A:
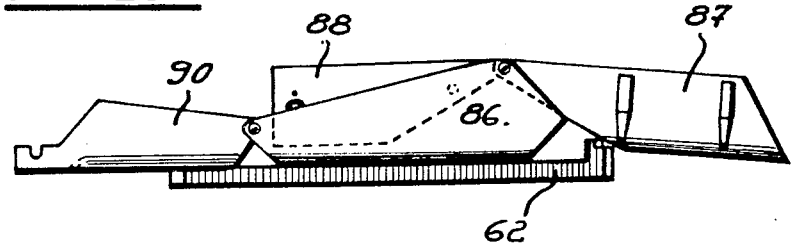

With reference to FIGS. 20A, 20B and 20C, a final form of embodiment of the present invention again comprises three rigid elements articulated on a rigid central sole; however, their disposition is different from that of the first embodiment described with respect to FIGS. 15–19: thus, the sole 86, which may be fixed on base 62 for securement to a ski, has two rigid elements 87, 88 articulated on the rear part and in this case on the same axis 89, and a rigid element 90 articulated at the forward end of sole 86 on an axis 91. In the out-of-service position, as shown in FIG. 20A, this embodiment occupies minimum volume, and the angle $\beta$ (see FIG. 20B) permits the introduction of the ski boot (not shown) between the two rigid elements articulated on the rear part of the sole 86. In operative position, as shown in FIG. 20C, the device may be locked for example by means of buckles 92' and clasps 92 or other locking means, such as those described in the preceding embodiment. Rigid element 90, articulated on the forward part of sole 86, may also have a hook 93 at its free end, cooperating in the operative position with a pin 94 carried by one of the two rigid elements that are articulated on the rear part of sole 86. Other features such as the means for preventing swinging movement, safety devices, the form of the rigid elements, the anatomical supports, etc., are analogous to those described in connection with the embodiment shown in FIGS. 15–19.

The boot to be fixed on the ski by means of the apparatus according to the invention is preferbly a comfortable flexible boot providing warmth, watertightness and which may be dressy. It may also be worn as desired, apart from the ski, as a hiking boot, an after-ski boot, etc. The apparatus of the present invention will impart to it the required rigidity when used as a ski boot.

It will be apparent that numerous variations may be resorted to without departing from the claimed scope of the invention. In particular, the locking means, particularly the clasps, ferrules, cables and pins, may be located or shaped in different ways. They may also be replaced by equivalent means.

What is claimed is:

1. A casing for a ski boot comprising at least two rigid portions articulatedly interconnected for relative swinging movement relative to each other between a use position in which they at least partially enclose the lower extremity of a skier, and an out-of-use position in which they occupy a smaller volume than in said use position, means for releasably locking said parts in said use position, and means for releasably locking said parts in said non-use position.

2. A casing as claimed in claim 1, in which said locking means for said two positions are at least in part the same.

3. A casing as claimed in claim 1, comprising a rigid sole that rises at its edges and surrounds the heel of the wearer, and three rigid elements articulatedly interconnected for vertical swinging movement about horizontal axes that are perpendicular to the length of the sole.

4. A casing as claimed in claim 3, one of said elements comprising an upper covering the forward portion of the foot of the skier and articulated to a forward portion of the sole, another said element comprising a forward part of the boot top articulated to one of said upper and base, and still another said element comprising a rear part of a boot top articulated to said base.

5. A casing as claimed in claim 4, said forward part of said boot top being articulated to said base.

6. A casing as claimed in claim 4, said forward part of said boot top being articulated to said upper.

7. A casing as claimed in claim 4, and locking means for maintaining said parts in said use position and comprising a cable fixed to said base adjacent the heel of the skier, said cable passing about a pin fixed to said forward part of the boot top and about guide means fixed to said rear part of the boot top, and a clasp on said rear part for tensioning said cable.

8. A casing as claimed in claim 4, in which in said out-of-use position said forward part of the boot top folds into the interior of the base and the rear part of the boot top folds down over said upper and forward part and base.

9. A casing as claimed in claim 8, and a cable that holds said articulated parts in said folded position.

10. A casing as claimed in claim 9, in which said cable holds said parts in said use position.

11. A casing as claimed in claim 1, in which said parts include a rigid base that rises at its edges to surround at least the heel of the skier, an upper comprised by two rigid parts covering the forward portion of the foot of the skier and articulated to said base about axes that extend lengthwise of said base, two other of said parts comprising front and rear parts of a boot top articulated on said base for vertical swinging movement relative to said base in the region of the tibio-tarsal joint of the skier.

12. A casing as claimed in claim 11, and means for locking said parts in said position of use, comprising a cable fixed to said base in the region of the heel of the wearer and passing about a pin fixed to said forward part of the boot top and about guide means fixed to said rear part of the boot top, and a clasp on said rear part of the boot top for tensioning said cable.

13. A casing as claimed in claim 12, in which in said out-of-use position said forward part of the boot top folds into the interior of the base and the rear part of the boot top folds down over said upper and forward part and base.

14. A casing as claimed in claim 13, and a cable that holds said articulated parts in said folded position.

15. A casing as claimed in claim 14, in which said cable holds said parts in said use position.

16. A casing as claimed in claim 1, said parts comprising a rigid base that rises at its edges about the foot of the skier, an upper that is articulated to the forward portion of the base, forward and rear parts of a boot top that are articulated to said base in the region of the tibio-tarsal joint of the wearer, and locking means for maintaining said parts in said use position, comprising a cable secured at one end to said base and trained about projections on said upper and said front and rear parts and terminating at its other end in a tightening clasp on said base.

17. A casing as claimed in claim 16, in which in said out-of-use position said forward part of the boot top folds into the interior of the base and the rear part of the boot top folds down over said upper and forward part and base.

18. A casing as claimed in claim 17, in which said cable holds said parts in said folded position.

19. A casing as claimed in claim 1, in which said at least two rigid portions include upper and lower portions and said upper portion is articulated to said lower portion for vertical swinging movement relative to said lower portion about a horizontal axis, between a raised use position and a lowered out-of-use position, said horizontal axis extending transversely of the casing.

* * * * *